US010739119B2

(12) United States Patent
Grunder et al.

(10) Patent No.: US 10,739,119 B2
(45) Date of Patent: Aug. 11, 2020

(54) FRAGMENTATION SLEEVE FOR AN AMMUNITION BODY

(71) Applicant: SAAB BOFORS DYNAMICS SWITZERLAND LTD., Thun (CH)

(72) Inventors: Bruno Grunder, Heimberg (CH); Markus Conrad, Thun (CH); Christian Herren, Liebefeld (CH)

(73) Assignee: Saab Bofors Dynamics Switzerland Ltd., Thun (CH)

( * ) Notice: Subject to any disclaimer, the term of this patent is extended or adjusted under 35 U.S.C. 154(b) by 0 days.

(21) Appl. No.: 16/068,184

(22) PCT Filed: Jan. 15, 2016

(86) PCT No.: PCT/CH2016/000006
§ 371 (c)(1),
(2) Date: Jul. 5, 2018

(87) PCT Pub. No.: WO2017/120685
PCT Pub. Date: Jul. 20, 2017

(65) Prior Publication Data

US 2019/0025031 A1 Jan. 24, 2019

(51) Int. Cl.

| | |
|---|---|
| ***F42B 12/32*** | (2006.01) |
| ***F42B 12/10*** | (2006.01) |
| ***F42B 12/28*** | (2006.01) |

(52) U.S. Cl.
CPC ..... *F42B 12/32* (2013.01); *F42B 12/10* (2013.01); *F42B 12/28* (2013.01)

(58) Field of Classification Search
CPC ..... F42B 12/32; F42B 12/28; F42B 12/22; F42B 12/24; F42B 12/26
USPC ..... 102/495, 496, 494, 491, 492
See application file for complete search history.

(56) References Cited

U.S. PATENT DOCUMENTS

| | | | | |
|---|---|---|---|---|
| 2,023,158 A * | 12/1935 | Williams | F42B 12/24 102/482 |
| 3,263,612 A | 8/1966 | Throner, Jr. | |
| 3,298,308 A * | 1/1967 | Throner, Jr. | F42B 12/32 102/496 |
| 4,493,264 A * | 1/1985 | Jameson | F42B 12/32 102/476 |
| 7,004,075 B2 | 2/2006 | Ronn | |

(Continued)

FOREIGN PATENT DOCUMENTS

| | | |
|---|---|---|
| DE | 1453828 A1 | 7/1970 |
| EP | 0718590 A1 | 6/1996 |
| WO | 2008073540 A2 | 6/2008 |

*Primary Examiner* — Joshua E Freeman
(74) *Attorney, Agent, or Firm* — Rankin, Hill & Clark LLP

(57) ABSTRACT

Fragmentation sleeve (1), for a generally circular cylindrically shaped ammunition body (2), whereby the sleeve (1) has an annular shape with an inner diameter at no place smaller than the outer diameter of the ammunition body (2), an outer diameter $D_a$, an internal surface $S_i$, an external surface $S_a$, and a height H, the sleeve is configured to be slid over and positioned on an outer surface (3) of the ammunition body (2) and comprises a plurality of fragments (4) embedded in a polymeric matrix (5).

20 Claims, 4 Drawing Sheets

(56) References Cited

U.S. PATENT DOCUMENTS

| | | | | |
|---|---|---|---|---|
| 8,381,657 | B1 * | 2/2013 | Hooke | F42B 8/26 102/481 |
| 8,671,840 | B2 * | 3/2014 | Scheid | F42B 12/32 102/495 |
| 8,967,409 | B2 * | 3/2015 | Desiles | B05B 13/0618 220/62.13 |
| 9,638,500 | B1 * | 5/2017 | Blyskal | F42B 12/22 |
| 2012/0192753 | A1 * | 8/2012 | Scheid | F42B 12/32 102/495 |
| 2012/0192754 | A1 * | 8/2012 | Scheid | F42B 12/24 102/495 |
| 2016/0273898 | A1 * | 9/2016 | Kravel | F42B 12/72 |

* cited by examiner

FRAGMENTATION SLEEVE FOR AN AMMUNITION BODY

BACKGROUND OF THE INVENTION

1. Field of the Invention

The invention relates to a fragmentation sleeve according to the preamble of claim 1.

2. Description of the Related Art

A fragmentation type weapon is known from U.S. Pat. No. 3,263,612 THRONER with two groups of discrete cubic slugs made of steel and where one group of slugs comprises a plurality of uniformly sized slugs differing in size from the slugs in the other group, the slugs being assembled in a cementitious matrix of plastic material thereby providing an outer hollow cylindrical shell for the explosive charge which is entirely encased by that shell. The larger fragments of the one group have a weight of 140 gran (corresponding to 8.4 grams) and the smaller fragments of the second group have a weight of 30 gran (corresponding to 1.8 grams), i.e. THRONER discloses discrete cubical fragments in different large/weight.

From U.S. Pat. No. 7,004,075 RONN ET AL. An ammunition unit is known comprising a plurality of exchangeable warhead modules to be fixed on the casing of the ammunition body by means of securing devices or retention parts. The modules have the shape of curved, relatively narrow segments arranged longitudinally on the generally cylindrical ammunition body. One module may contain uniformly large spherical pellets and another module may contain uniformly small spherical pellets.

BRIEF SUMMARY OF THE INVENTION

It is an object of the invention to provide a fragmentation sleeve for an ammunition body allowing a high degree of flexibility in the geometrical configuration of an ammunition body due to the different configuration of the sleeve allowing the rapid adaptation of the distribution, concentration and/or direction of fragments.

The invention solves the posed problem with a fragmentation sleeve comprising the features of claim 1.

The advantages of the fragmentation sleeve according to the invention are the following:

- optimal adaptability to the actual need of a certain type of ammunition based on standard ammunition which can be adapted to the battlefield requirements quickly and reliably due to its modularity;
- the flexibility of the geometrical configuration of the sleeve allows the use of an ammunition body with such sleeve in already existing systems;
- possibility of manufacturing of weight-optimized systems being of particular relevance for systems for guided missiles.

Further advantageous embodiments of the invention can be commented as follows:

In a special embodiment the fragmentation sleeve has the shape of a hollow cylinder.

In another embodiment the fragmentation sleeve has the shape of double hollow cone, a single hollow spherical zone or a multiple hollow spherical zone.

In a further embodiment the fragmentation sleeve is provided with a place holding annular element having an outside surface matching the inner surface of the sleeve and an internal surface, which is circular cylindrical for contacting a generally circular cylindrically shaped ammunition body.

In a special embodiment of the present invention the fragments consist of steel and have a mean weight in the range of 0.10 to 0.17 grams. This embodiment allows that advantage of good-controlled filling degree due to the matter that the fragments have similar weights, which in combination with the form of the sleeve, allows the advantage of the high degree of flexibility of the configuration of the region of effect. By using of materials with a higher density lies the mean weight in a higher range. The mean weight and the size of the fragments can also vary depending on the task of the fragmentation sleeve (e.g. air-to-air-missile).

In a further embodiment the polymeric matrix of the fragmentation sleeve is based on an epoxy resin, polyester and/or polyurethane.

In a further embodiment the polymeric matrix is fiber reinforced, preferably with glass fiber and/or carbon fiber.

In another embodiment the plurality of fragments of the fragmentation sleeve comprise at least two different types of fragments.

In a further embodiment one type of fragments has essentially spherical shape and the other type of fragments has a non-spherical, preferably cuboid, parallelepipedic or tetrahedral shape.

In a further embodiment at least two different types of fragments comprise different materials.

In a further embodiment the at least two different type of fragments are arranged in a single plane of the internal surface S; of the sleeve.

In another embodiment the at least two different type of fragments are arranged over each other.

In a further embodiment the plurality of fragments comprise a metal, metallic alloy or metal carbide, preferably steel, tungsten, tungsten carbide or aluminum.

In another embodiment the $V_F$:$V_M$ ratio between the total volume $V_F$ of the fragments and the total volume $V_M$ of the polymeric matrix is in the range of 0.5 and 0.9, preferably in the range of 0.6 and 0.75.

In a special embodiment of an assembly of at least one fragmentation sleeve and a generally circular cylindrically shaped ammunition body having a central axis X, the length L measured parallel to the central axis X and diameter D, the diameter D is at no place larger than $D_i$ and preferably equal to $D_i$.

In a further embodiment of the assembly the height H of the annular sleeve is smaller than the length L of the ammunition body and preferably is less than 20% of L.

In a further embodiment the assembly comprises N sleeves positioned longitudinally relative to the central axis X, whereby N≥2.

In a further embodiment the assembly comprises N sleeves positioned at least partially on each other relative to the central axis X, whereby N≥2.

In a further embodiment the ammunition body comprises a hollow charge which is comprised in a casing with the outer surface.

In a further embodiment the ammunition body is chosen from the group of non-barrel based ammunition, and in particular is a bomb, rocket or missile.

In a special embodiment of the manufacture of the assembly of at least one fragmentation sleeve and the shaped ammunition body the sleeve is slid over the body and positioned on an outer surface of the body.

In a further embodiment of the manufacture the sleeve is selected from a plurality P≥2 of sleeves, whereby at least one sleeve of the plurality P comprises fragments comprising a first material $M_1$ and at least one further sleeve of the plurality P comprises fragments comprising a second material $M_2$, whereby $M_1$ and $M_2$ are different materials.

This embodiment allows high variability by manufacturing in relation of election of materials (steel, tungsten, molybdenum or other heavy metals as well as light metals or also plastic materials).

In a special embodiment the kit comprising a generally circular cylindrically shaped ammunition body and a plurality P≥2 of fragmentation sleeves, whereby at least one sleeve of the plurality P comprises fragments comprising a first material $M_1$ and at least one further sleeve of the plurality P comprises fragments comprising a second material $M_2$, whereby $M_1$ and $M_2$ are different materials.

Definitions

"Fragments": The term "fragments" means in the present specification any pre-shaped fragmentations or splinters made of various hard or hardenable materials.

A BRIEF DESCRIPTION OF THE DRAWINGS

Several embodiments of the invention will be described in the following by way of example and with reference to the accompanying drawings in which.

DETAILED DESCRIPTION OF THE INVENTION

Figure 1:
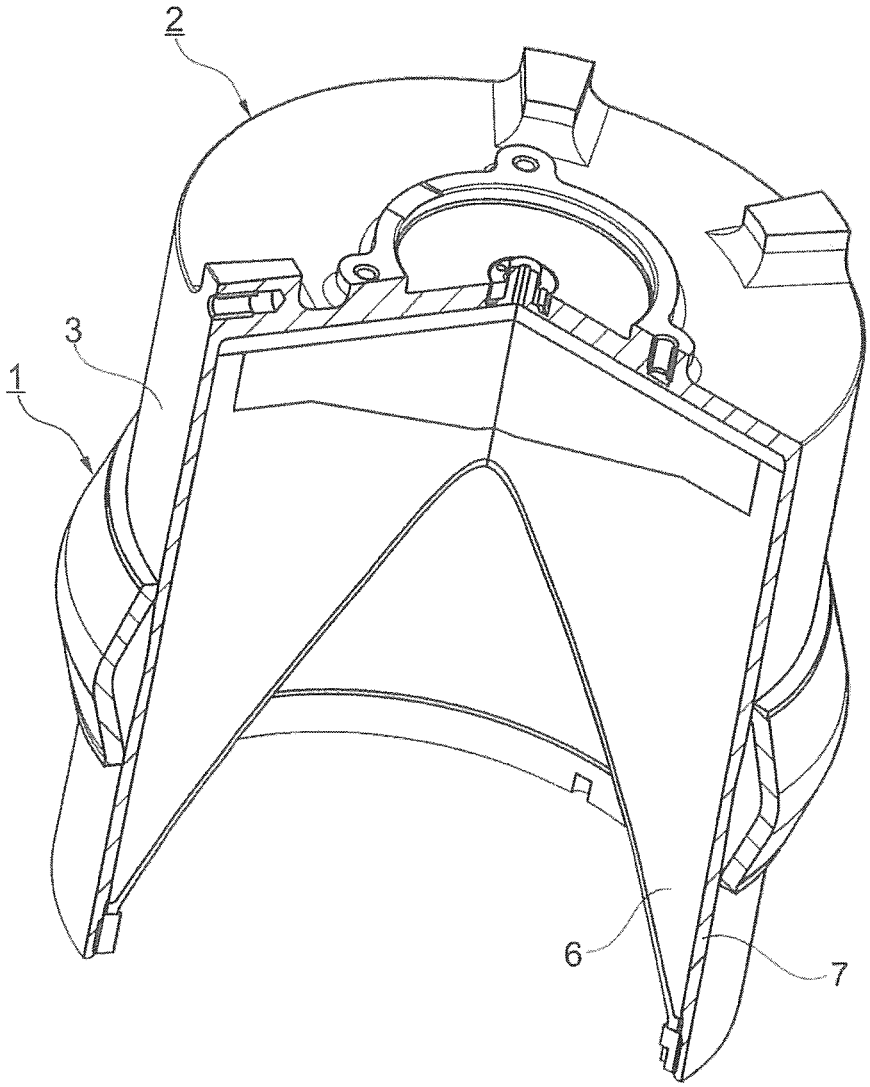
FIG. 1 illustrates schematically a perspective view of an embodiment of the fragmentation sleeve according to the invention mounted on a conventional hollow charge war head.

FIG. 1 illustrates an essentially circular cylindrically shaped ammunition body 2 comprising a hollow charge 6. The hollow charge 6 is comprised in a casing 7 having an outer surface 3. A fragmentation sleeve 1 is positioned on the outer surface 3 of the body 2. The sleeve 1 is annular and has a shape of a double hollow cone. The sleeve has an outer diameter $D_a$ and an inner diameter being at no place smaller than $D_i$ which is essentially equal to the diameter D of the ammunition body 2.

Figure 2:
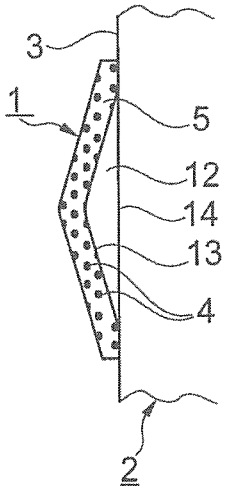
FIG. 2 illustrates schematically a view of a partial cross-section of the fragmentation sleeve of FIG. 1.

FIG. 2 illustrates schematically the cross-section of the ammunition body 2 having an outer surface 3. An annular fragmentation sleeve 1 having the shape of a double hollow cone is positioned on the outer surface 3 of the body 2. The sleeve 1 comprises a plurality of fragments 4 being embedded in a polymeric matrix 5. As shown in FIG. 2 the fragmentation sleeve 1 further comprises a place holding element 12. The place holding element 12 has an essentially annular shape and comprises an outside surface 13 matching the inner surface of the fragmentation sleeve 1 and an internal surface 14 being circular cylindrical and matching the outer surface 3 of the circular cylindrical ammunition body 2.

Figure 3:
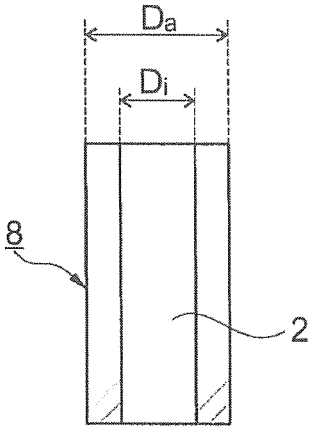
FIG. 3-6 illustrate various geometrical shapes of fragmentation sleeves in cross-section according to the invention.

FIG. 3 illustrates schematically a special embodiment of the present invention according to which the fragmentation sleeve 1 has a shape of a hollow cylinder 8. According to this embodiment the sleeve has a constant inner diameter $D_i$ and a constant outer diameter $D_a$. The inner surface of the cylindrical sleeve 8 matches the outside surface of the ammunition body 2. According to this embodiment the sleeve 1 does not comprise any place holding element.

Figure 4:
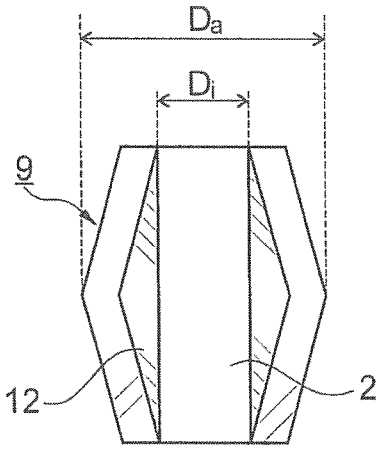

FIG. 4 illustrates schematically a further special embodiment of the present invention according to which the fragmentation sleeve 1 has a shape of a double hollow cone 9.

According to this embodiment the sleeve has an outer diameter varying over its external surface and an inner diameter varying over its internal surface. The inner diameter of the fragmentation sleeve is at no place smaller than $D_i$, whereby $D_i$ is equal to the diameter D of the circular cylindrically shaped ammunition body 2. The embodiment of the sleeve 1 according to FIG. 4 comprises a place holding element 12 having an outside surface 13 and an internal surface 14. The outside surface 13 of the place holding element 12 matches the internal surface of the sleeve. The internal surface 14 of the place holding element is circular cylindrical and matches the outer surface of the body 2.

Figure 5:
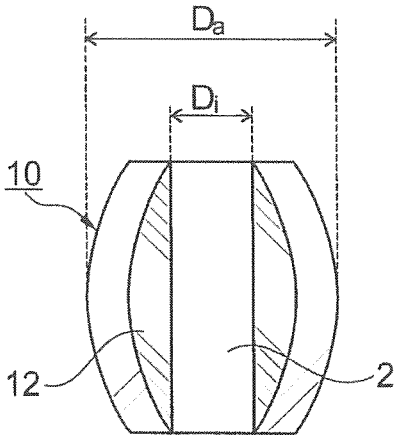

FIG. 5 illustrates schematically another embodiment of the present invention according to which the fragmentation sleeve 1 has a shape of a single hollow spherical zone 10. According to this embodiment the sleeve 1 has an outer diameter varying over its external surface and an inner diameter varying over its internal surface. The inner diameter is at no place smaller than $D_i$, which is equal to the diameter of D of the circular cylindrically shaped ammunition body 2. The embodiment of the sleeve 1 according to FIG. 5 comprises a place holding element 12 having an outside surface 13 and an internal surface 14. The outside surface 13 of the place holding element 12 matches the internal surface of the sleeve. The internal surface 14 of the place holding element 12 is circular cylindrical and matches the outer surface of the body 2.

Figure 6:
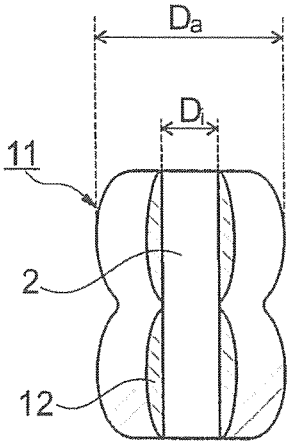

FIG. 6 illustrates schematically a further embodiment of the present invention according to which the fragmentation sleeve 1 has a shape of a double hollow spherical zone 11. According to this embodiment the sleeve 1 has an outer diameter varying over its external surface and an inner diameter varying over its internal surface. The inner diameter of the fragmentation sleeve is at no place smaller than $D_i$, whereby $D_i$ is equal to the diameter of D of the circular cylindrically shaped ammunition body 2. The embodiment of the sleeve 1 according to FIG. 6 comprises a place holding element 12 having an outside surface 13 and an internal surface 14. The outside surface 13 of the place holding element 12 matches the internal surface of the sleeve. The internal surface 14 of the place holding element 12 is circular cylindrical and matches the outer surface of the body 2.

Figure 7:
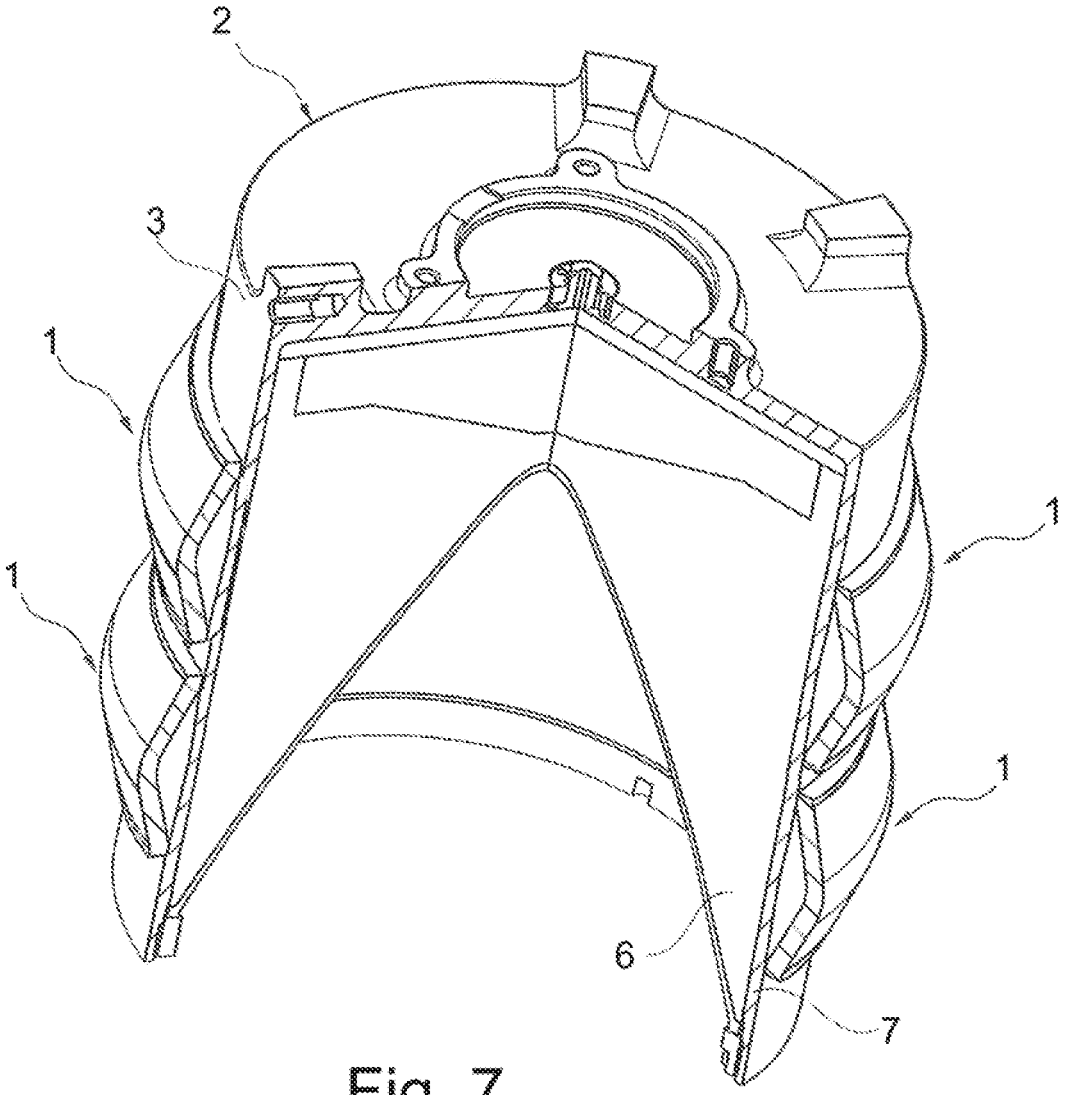
FIGS. 7 and 8 illustrate schematically perspective views of two embodiments of assemblies according to the invention that include a plurality of fragmentation sleeves.
Figure 8:
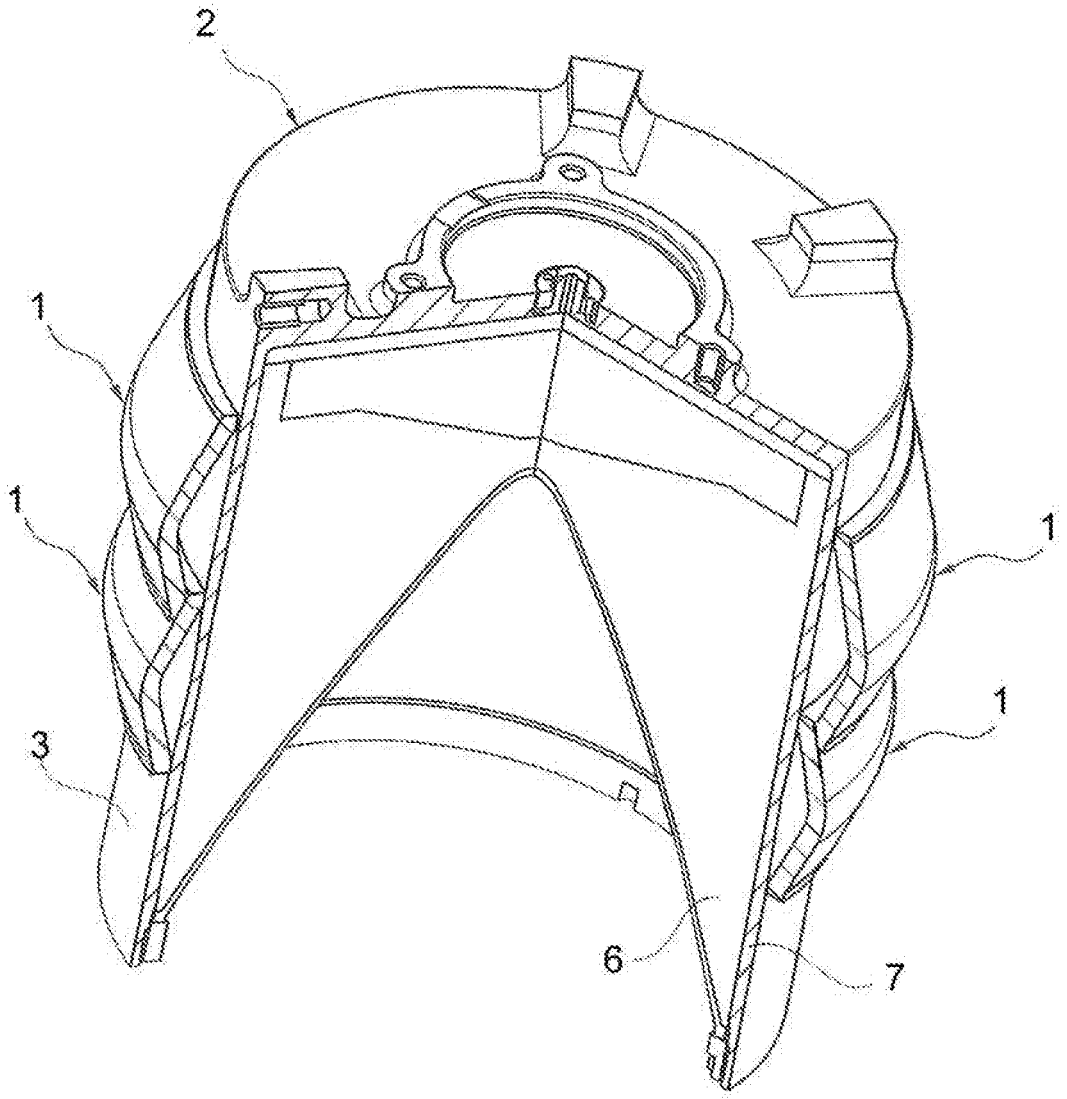

FIG. 7 illustrates schematically a perspective view of an embodiment of an assembly according to the invention that comprises a plurality of fragmentation sleeves 1 positioned longitudinally relative to each other along the central axis X. And, FIG. 8 illustrates schematically a perspective view of an embodiment of an assembly according to the invention that comprises a plurality of fragmentation sleeves 1 positioned at least partially on each other relative to the central axis X.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

The invention claimed is:

1. A fragmentation sleeve comprising a plurality of fragments embedded in a polymeric matrix, wherein:

the sleeve has one of:

a) an annular double hollow truncated conical shape;

b) an annular single hollow spherical shape; or c) an annular multiple hollow spherical shape;

the sleeve has an inner diameter at no place smaller than Di, an outer diameter Da, an internal surface Si, an external surface Sa, and a height H; and the sleeve is configured to slide over and be positioned on a generally circular cylindrically shaped ammunition body.

2. The fragmentation sleeve according to claim 1, further comprising a place holding annular element having an outside surface matching the inner surface Si of the sleeve and an internal surface, which is circular cylindrical for contacting the generally circular cylindrically shaped ammunition body.

3. The fragmentation sleeve according to claim 1, wherein the polymeric matrix comprises an epoxy resin, polyester and/or polyurethane.

4. The fragmentation sleeve according to claim 1, wherein the polymeric matrix is fiber reinforced.

5. The fragmentation sleeve according to claim 1, wherein the plurality of fragments comprise at least two different fragment types.

6. The fragmentation sleeve according to claim 5, wherein one of the at least two different fragment types has essentially a spherical shape and another one of the at least two different fragment types has a non-spherical shape.

7. The fragmentation sleeve according to claim 5, wherein each of the at least two different fragment types comprises a different material.

8. The fragmentation sleeve according to claim 5, wherein the at least two different fragment types are arranged in a single layer relative to the internal surface $S_i$ of the sleeve.

9. The fragmentation sleeve according to claim 5, wherein the at least two different fragment types are arranged in separate overlapping layers relative to the internal surface Si of the sleeve.

10. The fragmentation sleeve according to claim 1, wherein the plurality of fragments comprise metal, a metallic alloy or metal carbide.

11. The fragmentation sleeve according to claim 1, wherein a ratio $V_F$:VM between a total volume $V_F$ of the fragments and a total volume $V_M$ of the polymeric matrix is in a range of 0.5 and 0.9.

12. An assembly comprising at least one fragmentation sleeve according to claim 1 and a generally circular cylindrically shaped ammunition body having a central axis X, a length L measured parallel to the central axis X, an outer surface and a diameter D, wherein D is not larger than $D_i$.

13. The assembly according to claim 12, wherein the height H of the sleeve is smaller than the length L of the body.

14. The assembly according to claim 12, wherein the assembly comprises a plurality of fragmentation sleeves positioned longitudinally relative to each other along the central axis X.

15. The assembly according to claim 12, wherein the assembly comprises a plurality of fragmentation sleeves positioned at least partially on each other relative to the central axis X.

16. The assembly according to claim 12, wherein the ammunition body comprises a hollow charge which is comprised in a casing.

17. The assembly according to claim 12, wherein the ammunition body is a non-barrel based ammunition.

18. A method for configuring ammunition comprising sliding a fragmentation sleeve according to claim 1 over a generally circular cylindrically shaped ammunition body and positioning the sleeve on an outer surface of the body.

19. The method according to claim 18 where the fragmentation sleeve slid over the generally circular cylindrical shaped ammunition body is selected from a plurality of fragmentation sleeves, wherein at least one sleeve of the plurality of fragmentation sleeves comprises fragments comprising a first material $M_1$ and at least one other fragmentation sleeve of the plurality of fragmentation sleeves comprises fragments comprising a second material $M_2$, wherein $M_1$ and $M_2$ are different.

20. A kit comprising a plurality of fragmentation sleeves according to claim 1 and a generally circular cylindrically shaped ammunition body, wherein at least one fragmentation sleeve of the plurality of fragmentation sleeves comprises fragments comprising a first material $M_1$ and at least one other fragmentation sleeve of the plurality of fragmentation sleeves comprises fragments comprising a second material $M_2$, wherein $M_1$ and $M_2$ are different.

* * * * *